US011248355B2

(12) United States Patent
Choi et al.

(10) Patent No.: US 11,248,355 B2
(45) **Date of Patent: *Feb. 15, 2022**

(54) MULTIFUNCTIONAL RECOVERY APPARATUS OF SHORE ADHESION OILS

(71) Applicant: KOREA INSTITUTE OF OCEAN SCIENCE & TECHNOLOGY, Busan (KR)

(72) Inventors: Hyuek Jin Choi, Daejeon (KR); Cheon Hong Min, Sejong-si (KR); Meang-Ik Cho, Daejeon (KR); Jaewon Oh, Geoje-si (KR); Tae Kyeong Yeu, Sejong-si (KR); Seong-Soon Kim, Daejeon (KR)

(73) Assignee: Korea Institute of Ocean Science & Technology, Busan (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/330,164

(22) Filed: May 25, 2021

(65) Prior Publication Data

US 2021/0381183 A1 Dec. 9, 2021

(30) Foreign Application Priority Data

Jun. 3, 2020 (KR) ..... 10-2020-0067057

(51) Int. Cl.
*E01H 12/00* (2006.01)
*E02B 15/10* (2006.01)

(52) U.S. Cl.
CPC ..... *E01H 12/006* (2013.01); *E02B 15/102* (2013.01); *E02B 15/103* (2013.01); *E02B 15/106* (2013.01)

(58) Field of Classification Search
CPC ... E01H 12/006; E02B 15/046; E02B 15/048; E02B 15/102; E02B 15/103; E02B 15/105; E02B 15/106
(Continued)

(56) References Cited

U.S. PATENT DOCUMENTS 3,756,294 A * 9/1973 Rainey ..... B63B 25/082 210/242.3
3,966,614 A * 6/1976 Ayers ..... E02B 15/106 210/242.3
(Continued)

FOREIGN PATENT DOCUMENTS

KR 10-0255092 81 5/2000
KR 10-0991178 B1 11/2010
KR 10-2013-0087515 A 8/2013

OTHER PUBLICATIONS

Office Action dated Aug. 7, 2020 in Korean Application No. 10-2020-0067057, in 11 pages.
(Continued)

*Primary Examiner* — Christopher Upton
(74) *Attorney, Agent, or Firm* — Knobbe Martens Olson & Bear LLP

(57) ABSTRACT

This application relates to a multifunctional recovery apparatus of shore adhesion oils. The multifunctional recovery apparatus of shore adhesion oils removing and recovering oil spilling and sticking at a shore is mounted on a four-wheel vehicle. A skimmer assembly separating oil sticking to the surface of rocks at a shore, and absorbing and recovering an oil spill at the shore is installed at the front of the four-wheel vehicle. The skimmer assembly includes a rotary skimmer having a rotary roller separating oil, and a vacuum suction skimmer suctioning oil floating on a water
(Continued)

surface. The rotary skimmer and the vacuum suction skimmer may be selectively or simultaneously used, if necessary.

12 Claims, 10 Drawing Sheets

(58) Field of Classification Search
USPC ..... 210/170.01, 170.09, 170.11, 241, 242.3, 210/747.1, 747.5, 776, 923
See application file for complete search history.

(56) References Cited

U.S. PATENT DOCUMENTS 4,368,122 A * 1/1983 Ravagnan ..... E02B 15/102 210/242.3
4,410,426 A * 10/1983 Cloutier ..... E01H 12/006 210/923
4,542,550 A * 9/1985 Bennett ..... E01H 12/006 15/3
4,575,426 A * 3/1986 Littlejohn ..... E01H 12/006 210/242.4
4,758,355 A * 7/1988 Levine ..... E01H 12/006 210/923
4,921,605 A * 5/1990 Chastan-Bagnis .... E02B 15/046 210/242.3
5,076,919 A * 12/1991 Francisco, Jr. ..... E01H 12/006 210/241
5,302,210 A * 4/1994 Whyte ..... E01H 12/006 210/923
5,469,645 A * 11/1995 Aiken ..... E01H 5/104 210/923
5,685,979 A * 11/1997 Governale ..... E02B 15/102 210/242.3
10,927,519 B1 * 2/2021 Choi ..... E02B 15/103

OTHER PUBLICATIONS

Decision to Grant dated Aug. 18, 2020 in Korean Application No. 10-2020-0067057, in 5 pages.

* cited by examiner

MULTIFUNCTIONAL RECOVERY APPARATUS OF SHORE ADHESION OILS

CROSS REFERENCE TO RELATED APPLICATION

The present application claims priority to Korean Patent Application No. 10-2020-0067057, filed Jun. 3, 2020, the entire contents of which are incorporated herein for all purposes by this reference.

BACKGROUND

Field

The present disclosure a multifunctional recovery apparatus of shore adhesion oil and, more particularly, to a multifunctional recovery apparatus of shore adhesion oil which is mounted on a four-wheel vehicle that can be driven on an off-road and which can recover or remove a large amount of oil flowing and sticking to a beach, a shore, or a coast.

Description of the Related Technology

In general, an oil spill accident on the sea damages the natural ecosystem such as not only the marine ecosystem, but a beach, shore, or coast of the area adjacent to the spill accident.

An oil spill contaminates the sea by forming an oil film on the sea and contaminates an entire shore by being tossed about by wind or currents while floating on the sea for a long time. In particular, an oil spill remains on a sandy beach or a gravelly field at low tide, thereby consequently causing severe damage to the environment and the ecosystem throughout a large area of a shore. Accordingly, in order to prevent additional environmental contamination, it is important to recover the oil spilling on the sea and moving to the shore or quickly remove the oil stuck to the shore.

Various methods such as a method that uses an oil fence and a method that uses an adsorbent or a scoop net are currently used for oil spill cleanup on the sea.

SUMMARY

The present disclosure has been made in an effort to solve the problems and an objective of the present disclosure is to provide a multifunctional recovery apparatus of shore adhesion oils which is configured to be able to quickly recover and remove coming or sticking oil while moving around a shoreline or on the ground.

Another objective of the present disclosure is to provide a multifunctional recovery apparatus of shore adhesion oils which is configured to be able to carry oil recovered at the site immediately to an external oil storage tank or carry the oil to an external carrying vehicle.

The objectives of the present disclosure are not limited to those described above and other objectives may be made apparent to those skilled in the art from the following description.

In order to achieve the objectives, a multifunctional recovery apparatus of shore adhesion oils according to an embodiment of the present disclosure is configured to be mounted on a four-wheel vehicle and to remove and recover oil flowing to a shore or oil stuck to the shore. The multifunctional recovery apparatus includes; a skimmer assembly installed at the front of the four-wheel vehicle, separating oil sticking to a surface of sand or gravel at a shore, and absorbing and recovering oil flowing to the shore; and an oil storage tank selectively receiving oil recovered from the skimmer assembly.

The skimmer assembly includes: a rotary skimmer separating and collecting oil sticking to a surface of sand or gravel at a shore; and a vacuum suction skimmer disposed behind the rotary skimmer and adsorbing oil flowing on a water surface.

The rotary skimmer includes: a skimmer body configured to separate oil; a scraper protruding toward the skimmer body to separate oil and foreign substances from the skimmer body; a discharge pipe configured to discharge the oil and the foreign substances separated by the scraper to the outside; and a transfer pump disposed under the scraper and transferring oil and water dropping from a lower portion of the scraper to the oil storage tank or to the outside, and an oil recovery bag for recovering the discharged oil and foreign substances is detachably coupled to an outlet of the discharge pipe.

The transfer pump may include: a first transfer line having a first end connected to the transfer pump and a second end connected to the oil storage tank; and a second transfer line having a first end connected to the transfer pump and a second end connected to an external discharge hose provided from the outside, and a valve selectively opening and closing the second transfer line is disposed at the first end of the second transfer line.

The skimmer body may include: a separator disposed to be able to horizontally rotate and having coupling protrusions at both ends, respectively; a cover plate having both sides to which both ends of the separator are rotatably coupled, respectively, and shielding an upper portion of the separator; a guide screw rotatably disposed inside the cover plate and transferring oil and foreign substances separated by the scraper to the discharge pipe; and an oil storage container disposed under the scraper, receiving oil and water dropping from the lower portion of the scraper, and having the transfer pump therein.

The separator may include: a rotary roller disposed to be able to rotate horizontally with respect to the ground; and a brush spirally disposed on an outer surface of the rotary roller in a longitudinal direction, and the brush may be a bunch of fibers made of a lipophilic material.

The separator may include a rotary drum disposed to be able to rotate horizontally with respect to the ground, and a surface of the rotary drum may have lipophilicity.

The skimmer assembly may further include a vacuum tank connected to the vacuum suction skimmer and transmitting vacuum suction force to the vacuum suction skimmer.

The multifunctional recovery apparatus may further include an up-down actuator having a first side connected to the vacuum suction skimmer and a second side connected to the four-wheel vehicle, and moving up and down the vacuum suction skimmer.

The multifunctional recovery apparatus includes connection arms disposed in parallel with each other at the front of the four-wheel vehicle, each having a first side hinged to the front of the four-wheel vehicle and a second side connected to the cover plate.

A tongs-shaped gripper may be disposed at the second ends of the connection arms, so the rotary skimmer may be separably coupled.

A disc-type oil recoverer may be separably coupled to the grippers.

The disc-type oil recoverer may include: a frame body forming an external shape and a frame; a rotary shaft rotatably installed on the frame body; a drum composed of a plurality of discs arranged on the rotary shaft with regular intervals in a longitudinal direction of the rotary shaft; and a drum skimmer protruding from the frame body facing the drum and separating oil and foreign substances from a surface of the drum.

The frame body may be made of FRP (fiber reinforced plastics).

The details of other exemplary embodiments are included in the following detailed description and the accompanying drawings.

The multifunctional recovery apparatus of shore adhesion oils according to an embodiment of the present disclosure can be mounted on a four-wheel vehicle that can be driven even on an off-road, and can remove and recover approaching oil and sticking oil while moving along a beach, a shore, or a coast. Accordingly, there is an effect that it is easy to approach and move around on a shore in consideration of the characteristics of the shore, to remove a large amount of oil within short time, to reduce time and costs for oil spill cleanup, and to safely perform work.

Further, according to the multifunctional recovery apparatus of shore adhesion oils according to an embodiment of the present disclosure, it is possible to use the rotary skimmer or the vacuum suction skimmer, or simultaneously use the rotary skimmer and the vacuum suction skimmer, depending on the characteristics of oil flowing to a shore or sticking to a shore, work environments, etc. Further, if necessary, a user can quickly remove and recover oil by directly suctioning the oil using a portable nozzle. Accordingly, there is another effect that it is possible to make oil spill cleanup efficient.

Further, according to the multifunctional recovery apparatus of shore adhesion oils according to an embodiment of the present disclosure, since oil recovered from the skimmer assembly can be stored in the oil storage tank mounted on a four-wheel vehicle and oil recovered in an emergency can be stored, so it is possible to deal with an emergency. Further, since it is possible to store a large amount of oil recovered and removed by the skimmer assembly directly in a specific carrying vehicle without through an oil storage tank in a vehicle, it is possible to deal with a large amount of oil within short time, so there is an effect of quickly and economically performing oil spill cleanup.

The effects of the present disclosure are not limited to those described above and other effects not stated herein may be made apparent to those skilled in the art from claims.

BRIEF DESCRIPTION OF THE DRAWINGS

The above and other objectives, features and other advantages of the present disclosure will be more clearly understood from the following detailed description when taken in conjunction with the accompanying drawings.

DETAILED DESCRIPTION

Figure 1:
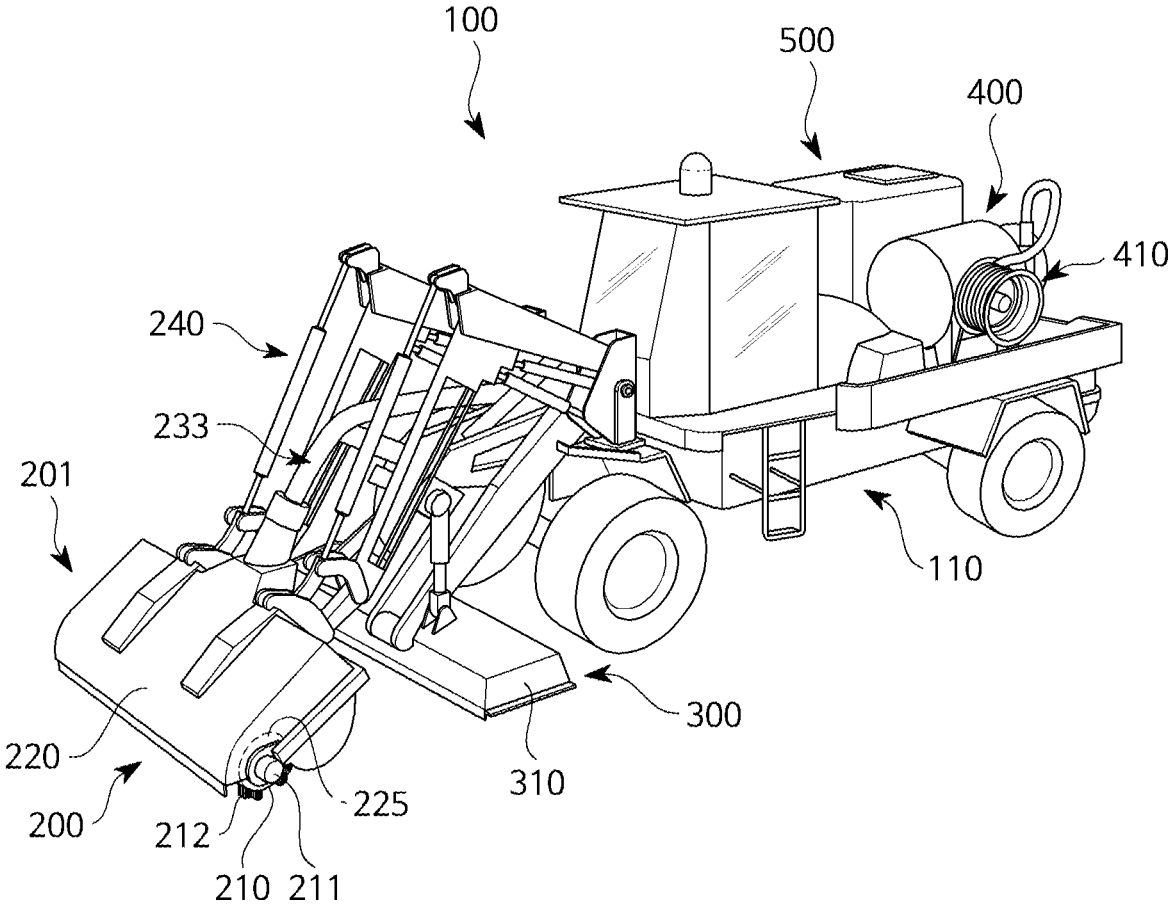
FIG. 1 is a perspective view showing the configuration of a multifunctional recovery apparatus of shore adhesion oils according to an embodiment of the present disclosure.

Current oil spill cleanup methods, which are usually used on the sea, have a high possibility of a secondary accident (stranding or capsizing of an oil spill response vessel) at a shallow sea area with a low water depth (less than 1 m of water depth) or close to a shore, so oil spill cleanup is very difficult and dangerous.

Further, it is difficult to deal with a large-scale oil spill accident in the early stage due to limitative factors such as bad weather, so a large amount of spilling oil unavoidably flows and sticks to a shore.

When an oil spill accident occurs on the sea, diffusion of the oil floating on the sea is prevented or some of the oil is recovered using oil spill response vessels, adsorbents, scoop nets, etc. However, in spite of oil spill cleanup, the oil that has reached a shore, which is about 70% of the oil spill, is left alone, so the damage due to this oil is being spotlighted as a very big problem.

There are no equipment or tools that can remove a large amount of oil flowing to a shore or oil sticking to sand, gravel, or the like after reaching a shore, or that can separate, remove, and recover only oil. Accordingly, most of an oil spill is removed by primitive cleanup methods such as manual scooping or rocky cleaning that uses an oil adsorbent, so the recovery ratio of very low. Further, when workers step on the oil or the removing work continues for a long period of time, the oil stuck to a shore permeates more into the ground. Accordingly, environmental contamination gets severe, and removal and restoration take long time, so a large cost is required. Further, a large amount of wastes for cleanup such as oil adsorbents used for rocky cleaning is generated and the health of workers such as local people and volunteers participating in the work for cleaning the shore is harmed in some cases.

Accordingly, there is a need for an apparatus or a method that can save time and costs and can quickly remove not only oil flowing to a shore, but also oil stuck to the shore due to an oil spill accident.

Hereafter, exemplary embodiments of the present disclosure are described in detail with reference to the accompanying drawings such that those skilled in the art can easily achieve the present disclosure.

Technologies well known in the art and not directly relevant to the present disclosure are not described in the following description of embodiments. This is for clearly communicating the subject of the present disclosure by omitting unnecessary description.

Similarly, some components are exaggerated or schematically shown in the drawings. Further, the sizes of components do not fully reflect the actual sizes. Same or corresponding components are given same reference numerals in the drawings.

FIG. 1 is a perspective view showing the configuration of a multifunctional recovery apparatus of shore adhesion oils according to an embodiment of the present disclosure.

As shown in FIG. 1, a multifunctional recovery apparatus of shore adhesion oils 100 is mounted on a four-wheel vehicle 110. In this embodiment, the four-wheel vehicle 110, which can be driven on an off-road, for example, may be a tractor or an ATV (All-Terrain Vehicle). This is because the vehicle can be easily driven on a sandy beach, a gravel field, etc.

In particular, when the four-wheel vehicle 110 has a structure like a tractor for construction, the four-wheel vehicle 110 is fundamentally the same as common vehicles, but has a strong engine, so it has strong towing power and is strong.

A skimmer assembly is disposed at the front of the four-wheel vehicle 110. The skimmer assembly separates oil sticking to the surface of sand or gravel at a shore and absorbs and recovers oil flowing to a shore.

In this embodiment, the skimmer assembly may include a rotary skimmer 200.

The rotary skimmer 200 separates and collects adhering oil, a lump of tar, etc. sticking to the surface of sand or gravel at a shore. The rotary skimmer 200 may include a skimmer body 201, a scraper 226, a discharge pipe 230, a transfer pump 232, and connection arms 240.

In this embodiment, the skimmer body 201 may include a separator composed of a rotary roller 210 and a brush 212, a cover plate 220, and a guide screw 244.

Figure 2:
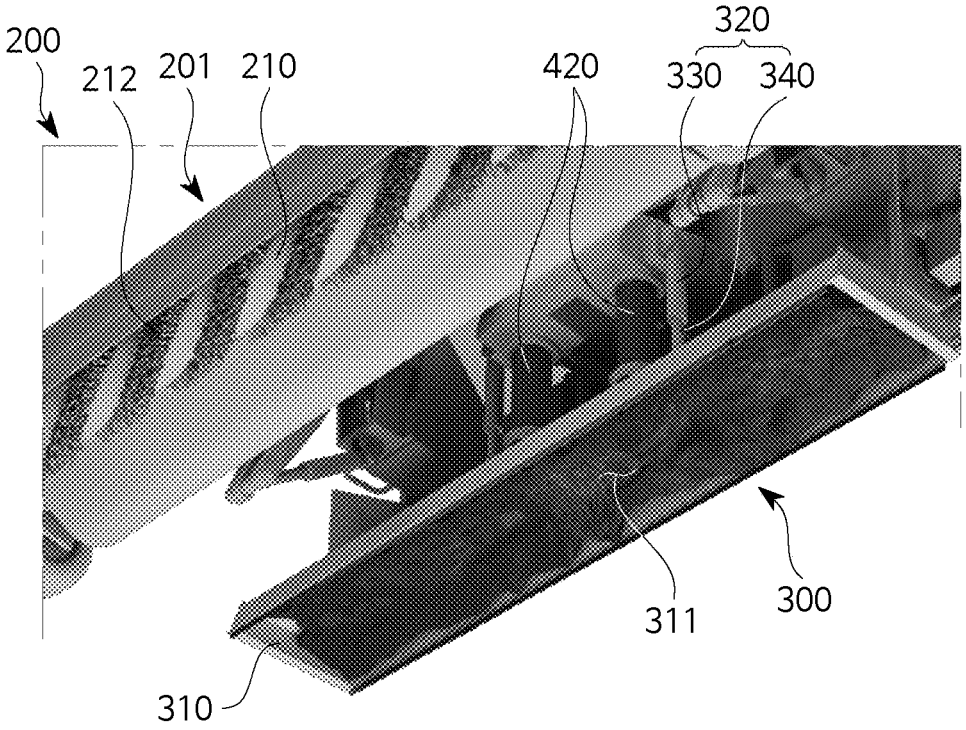
FIG. 2 is a perspective view partially showing the configuration of a skimmer assembly according to an embodiment of the present disclosure.

As shown in FIG. 2, the separator may be composed of the rotary roller 210 and the brush 212. The rotary roller 210 has a cylindrical shape having a predetermined length and is can be rotated horizontally with respect to the ground. Both ends of the rotary roller 210 are rotatably connected to the cover plate 220.

As shown in FIG. 1, a coupling protrusion 211 may be formed at each of both ends of the rotary roller 210. The coupling protrusions 211 protrude in opposite directions. The coupling protrusions 211 may be rotatably coupled to both sides of the cover plate 220, respectively.

The brush 212 may be spirally disposed on the outer surface of the rotary roller 210 in the longitudinal direction of the rotary roller 210. This is for moving oil separated from the brush 212 toward the discharge pipe 230.

The brush 21 scrubs and separates oil floating on a water surface or adhering oil, a lump of tar, etc. sticking to the surface of rocks, etc. In this embodiment, the brush 212 may be a bunch of fibers made of a lipophilic material. This is for making oil effectively stick to the brush 212.

Figure 3:
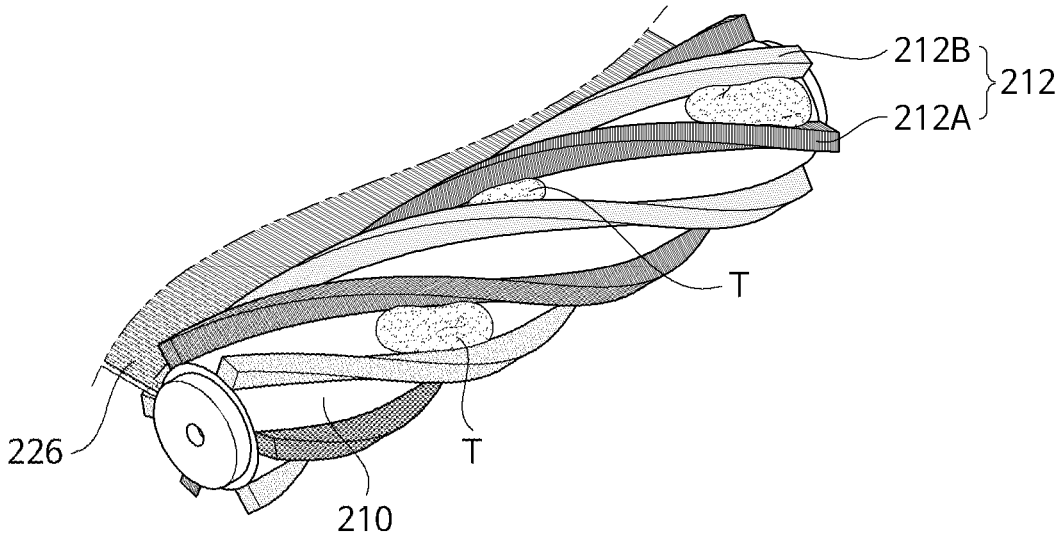
FIG. 3 is a schematic perspective view partially showing the configuration of a rotary skimmer according to an embodiment of the present disclosure.

As shown in FIG. 3, the brush 212 may be composed of a pair of first brush 212A and second brush 212B made of different materials. In this embodiment, the first brush 212A may be made of a harder material than that of the second brush 212B and the second brush 212B may be made of a softer material than that of the first brush 212A.

This is for making it possible to scrape and separate adhering oil, a lump of tar, etc. sticking to the first brush 212A and collect same with the second brush 212B.

The first brush 212A and the second brush 212B may be spaced a predetermined distance apart from each other. This is for enabling foreign substances such as a marine waste T to be stuck for collection between the first brush 212A and the second brush 212B. The collected waste T, etc. can be separated and removed by a scraper 216 to be described below.

In this embodiment, three pairs of the first brush 212A and the second brush 212B are arranged with regular intervals. The first brush 212A and the second brush 212B may spirally extend on the outer surface of the rotary roller 210 in the longitudinal direction of the rotary roller 210.

The upper portion of the rotary roller 210 is shielded by the cover plate 220. Both sides of the cover plate 220 are rotatably connected to both ends of the rotary roller 210, respectively.

As shown in FIG. 3, the scraper 226 may be disposed inside the cover plate 220 in parallel with the rotary roller 210. The side of the scraper 226 which faces the rotary roller 210 may be in a saw shape. The scraper 226 is provided to scrape and separate adhering oil, solid oil, high-viscosity oil, etc. sticking to the brush 212. The adhering oil, solid oil, high-viscosity oil, etc. separated by the scraper 226 can be pushed toward the discharge pipe 230.

In this embodiment, several scrapers 226 may be arranged with regular intervals like blades. This is for enabling low-viscosity oil and water to be discharged down through between the scrapers 226. The scraper 226 may be made of a polypropylene (PP) that is strong against corrosion and deformation.

Though not shown in the figures, a guide wheel may be disposed at each of both sides of the cover plate 220. The guide wheels are provided for smooth movement of the rotary skinner 200 in the same direction as the movement direction of the four-wheel vehicle 110.

As shown in FIG. 1, coupling covers 225 may be disposed on both sides of the cover plate 220 at positions corresponding to the coupling protrusions 211. The coupling covers 225 may be hinged to both sides of the cover plate 220 by hinge pins (not shown). The coupling covers 225 are coupled to the coupling protrusions 211, thereby connecting the rotary roller 210 to the cover plate 220.

In this embodiment, the insides of the coupling covers 225 may be formed in groove shapes corresponding to the coupling protrusions 211.

When it is required to separate the rotary roller 210 for the cover plate 220, a worker rotates the coupling covers 225 away from the cover plate 220 and then can separate the rotary roller 210 from the cover plate 220.

A first side, that is, the inlet of the discharge pipe 230 may be connected to a side of the upper portion of the cover plate 220 and a second side, that is, the outlet thereof may be tapered away from the cover plate 220. This is for smoothly guiding oil to an oil recovery bag 231 connected to the second side of the discharge pipe 230.

The oil recovery bag 231 may be detachably coupled to the outlet of the discharge pipe 230. To this end, the second side of the discharge pipe 230 and the oil recovery bag 231 may be detachably coupled to each other in various ways, for example, using a Velcro tape, a magnet, and a magnetic member. When the oil recovery bag 231 is fully filled with solid oil, high-viscosity oil, marine wastes, etc. discharged from the discharge pipe 230, the oil recovery bag 231 can be removed and replaced with a new oil recovery bag 231 by a worker. The oil recovery bag 231 may be made of a transparent or translucent material so that the internal capacity can be seen.

Figure 4:
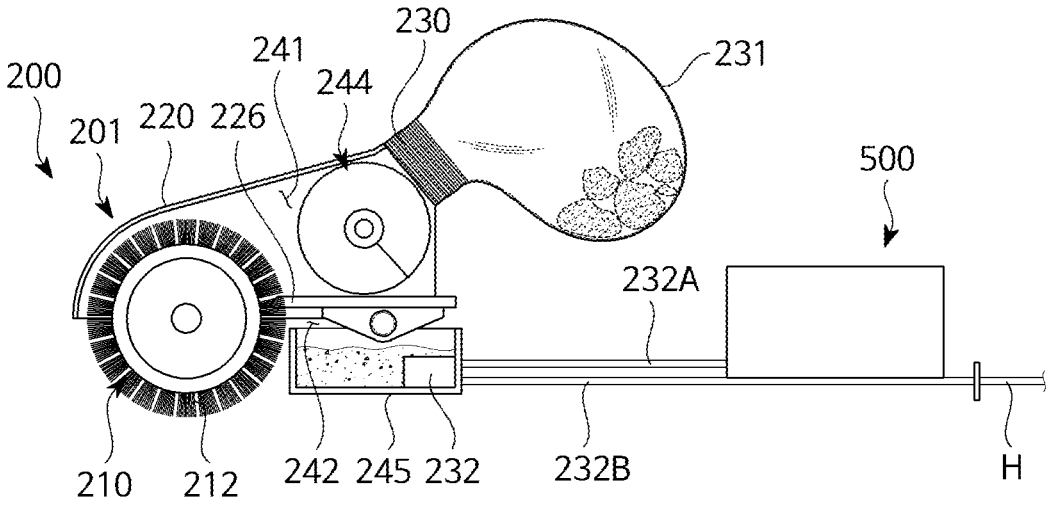
FIG. 4 is a schematic view showing the configuration of the skimmer assembly according to an embodiment of the present disclosure.
Figure 6:
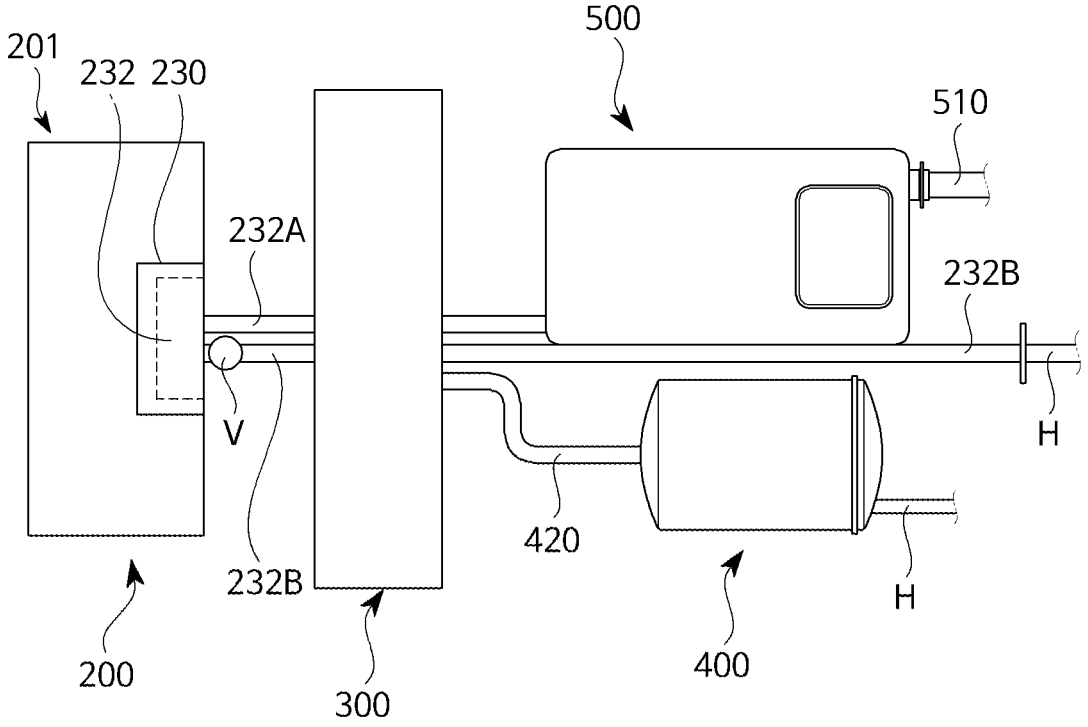
FIG. 6 is a schematic view showing the configuration of a multifunctional recovery apparatus of shore adhesion oils according to an embodiment of the present disclosure.

The transfer pump 232 may be disposed inside the cover plate 220. In this embodiment, the transfer pump 232, as shown in FIG. 4, may be disposed in an oil storage container 245 to be described below. The transfer pump 232 transfers oil and water collected from the rotary skinner 200 to an oil storage tank 500. In this embodiment, as shown in FIGS. 4 and 6, the transfer pump 232 may include a first transfer line 232A and a second transfer line 232B.

A first end of the first transfer line 232A may be connected to the transfer pump 232 and a second end thereof may be connected to the oil storage tank 500. That is, the first transfer line 232A functions as a passage that guides low-viscosity oil, seawater, etc. to the oil storage tank 500.

A first end of the second transfer line 232B may be connected to the transfer pump 232 and a second end thereof may be selectively connected to the oil storage tank 500 or an external discharge hose H provided from the outside. That is, the second transfer line 232B functions as a passage that guides adhering oil, low-viscosity oil, etc. to the oil storage tank 500 or the external discharge hose H. The external discharge hose H is a hose connected to an oil recovery tank 600 to be described below, but is not limited thereto. For example, the external discharge hose may be a hose connected to a specific carrying vehicle.

In this embodiment, a valve V is installed at an end of the second transfer line 232B, so oil passing through the second transfer line 232B can be discharged outside through the external discharge hose H or can be moved to the oil storage tank 500 by controlling the valve V. This is because when there is a large amount of oil to be recovered, it is possible to deal with a large amount of oil within short time by storing the oil in an external carrying vehicle rather than the oil storage tank 500 by controlling the valve V.

As shown in FIG. 1, the outer surfaces of end portions of the first transfer line 232A and the second transfer line 232B may be covered with a tube 233. The tube 233 protects the first transfer line 232A and the second transfer line 232B. A first end of the tube 233 may be selectively coupled to the transfer pump 232 together with the first ends of the first transfer line 232A and the second transfer line 232B. For example, they may be coupled by thread-fastening, etc.

Meanwhile, in this embodiment, as shown in FIG. 4, the inside of the cover plate 220 may be divided into an upper space 241 and a lower space 242 by the scraper 226.

A guide screw 244 may be disposed in the upper space 241. The guide screw 244 is rotatably disposed inside the cover plate 220. The guide screw 244 may spirally extend in parallel with the rotary roller 210. The guide screw 244 recovers solid oil, high-viscosity oil, marine wastes, etc. separated by the scraper 226 into the oil recovery bag 231 through the discharge pipe 230.

As shown in FIG. 4, the oil storage container 245 may be disposed under the scraper 226. In this embodiment, the oil storage container 245 is a part that receives oil dropping from the scraper 226, for example, oil, water, etc. dropped by compression between the scraper 226 and the brush 212. The transfer pump 232 is disposed in the oil storage container 245. Accordingly, the transfer pump 232 can transfer the oil and water in the oil storage container 245 to the oil storage tank 500 or to the outside.

In this embodiment, the separator is composed of the rotary roller 210 and the brush 212, but is not limited thereto. For example, the separator, as shown in FIG. 5, may be a rotary drum 260.

The rotary drum 260 has a substantially cylindrical shape and can rotate horizontally with respect to the ground. Both ends of the rotary roller 260 are rotatably connected to the cover plate 220.

The surface of the rotary drum 260 may be given a lipophilic characteristic. This is for being able to adsorb only oil. To this end, a material obtained by processing wool fabric, cotton fabric, sawdust, etc. treated to have a lipophilic surface may be attached to the surface of the rotary drum 260.

Figure 5:
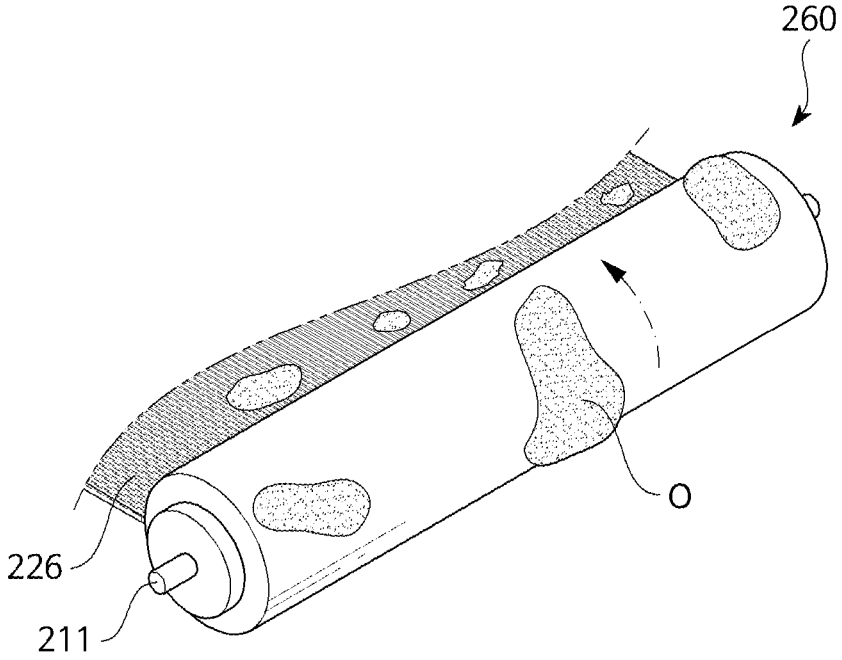
FIG. 5 is a schematic perspective view partially showing the configuration of a rotary skimmer according to another embodiment of the present disclosure.

The rotary drum 260 is suitable for removing particularly high-viscosity oil O of oil, as shown in FIG. 5.

As described above, it is possible to further increase the oil removal efficiency by replacing the rotary drum 260 or the rotary roller 210 equipped with the brush 212 in accordance with the characteristics of oil. In this embodiment, since the separator is detachably coupled to the cover plate 220, there is an effect that the separator can be washed and reused.

Meanwhile, as shown in FIG. 1, the rotary skimmer 200 is movably connected to the four-wheel vehicle 110 through the connection arms 240.

As shown in FIG. 1, the connection arms 240 may be disposed in parallel with each other at the front of the four-wheel vehicle 110. First sides of the connection arms 240 are hinged to the front of the four-wheel vehicle 110 and second sides are connected to the cover plate 220. Accordingly, the position of the rotary skimmer 200 can be changed up and down by operation of the connection arms 240.

In this embodiment, the second sides of the connection arms 240 are integrally connected to the cover plate 220, but the present disclosure is not limited thereto. For example, a tongs-shaped gripper 240' is disposed at the second side of each of the connection arms 240, so the second side can be separably coupled to the cover plate 220. This is for enabling the rotary skimmer 200 to be separably coupled to the second sides of the connection arms 240. In this embodiment, the grippers 240' may be operated by a hydraulic cylinder.

Figure 8A:
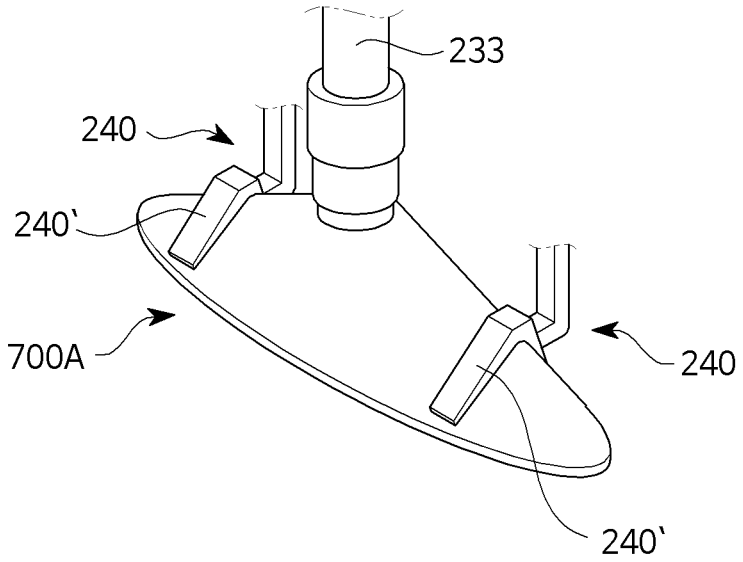
FIGS. 8A and 8B are partial perspective views partially showing the configuration of a multifunctional recovery apparatus of shore adhesion oils according to another embodiment of the present disclosure.
Figure 8B:
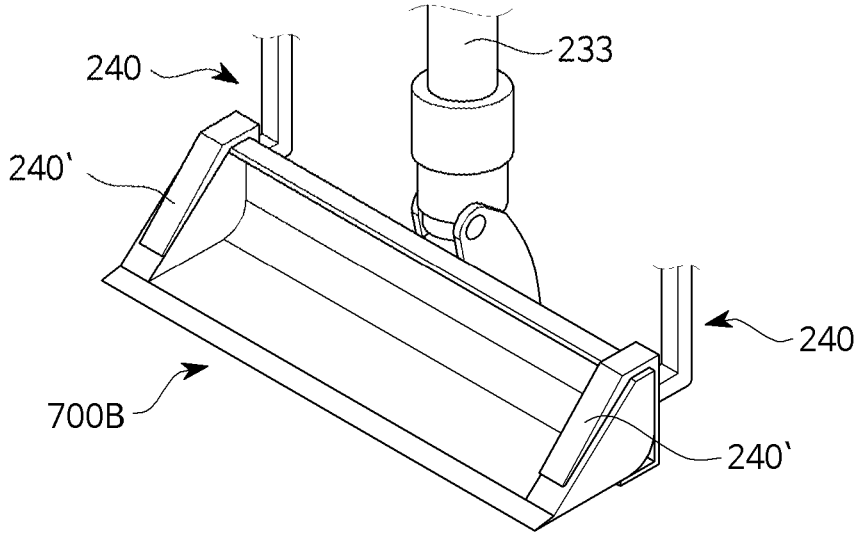

In this case, as shown in FIGS. 8A and 8B, instead of the rotary skimmer 200, various tools and equipment, for example, a separate vacuum suction unit 700A shown in FIG. 8A or a dipper 700B shown in FIG. 8B which can receive a large amount of a lump of oil spill, a lump of solidified oil, etc. may be selectively coupled to the grippers 240' of the connection arms 240, if necessary. As described above, as tools and equipment that supports work to be suitable for site situations and recover various kinds of oil are replaced and coupled to the grippers 240' of the connection arms 240, workability can be improved.

To this end, the first end of the tube 233 and the transfer pump 232 may be separably coupled to each other. The first end of the tube 233 may be hinged to the vacuum suction unit 700A or the bucket 700B.

Figure 9:
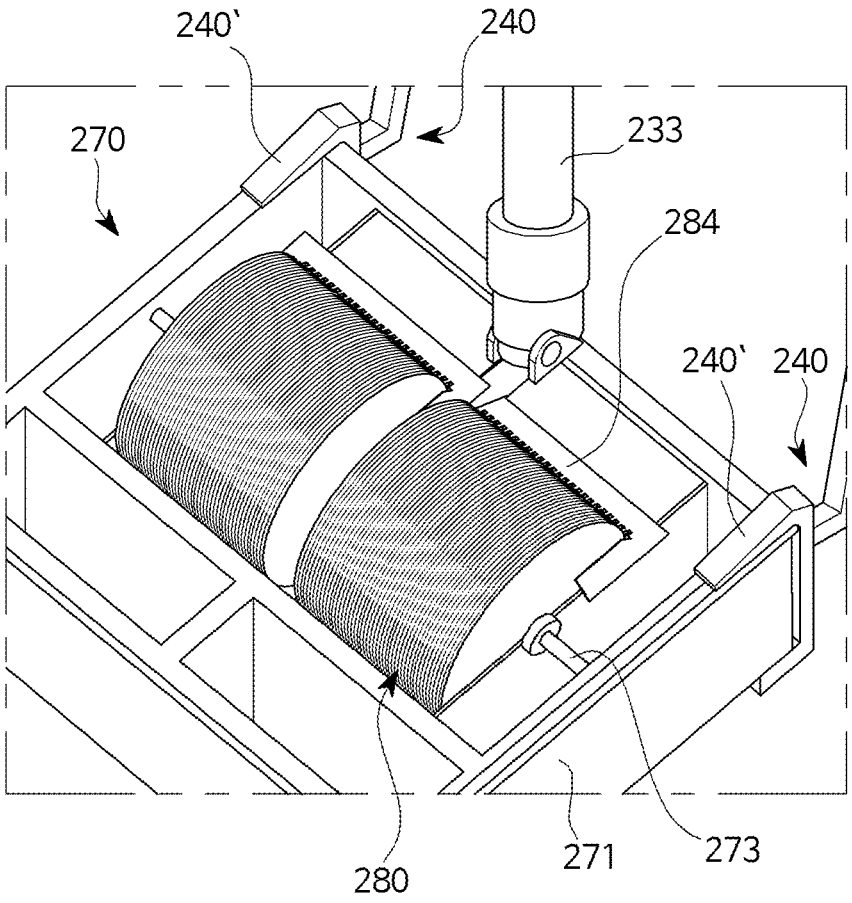
FIG. 9 is a partial perspective view partially showing the configuration of a multifunctional recovery apparatus of shore adhesion oils according to another embodiment of the present disclosure.

Meanwhile, as shown in FIG. 9, a disc-type oil recoverer 270 may be separably coupled to the grippers 240' of the connection arms 240. In this embodiment, the disc-type oil recoverer 270 is a kind of lipophilic oil-water separator that separates oil flowing to a shore by adsorbing the oil.

The external shape and frame of the disc-type oil recoverer 270 is formed by a frame body 271. The frame body 271 may be made of a material strong against corrosion, for example, FRP (fiber reinforced plastics). The specific gravity of common FRP is light as about ¼ of steel and the specific of FRP obtained by reinforcing carbon fiber (CF) is lighter as about 1.5, so FRPs have excellent mechanical properties. Further, FRPs have the anticorrosion of plasticbased matrixes and excellent formability, so FRPs are suitable for form the body of the disc-type oil recoverer 270 that comes in direct contact with seawater.

As shown in FIG. 9, a rotary shaft 273 is rotatably mounted on the frame body 271. The rotary shaft 273 is a part on which the drum 280 to be described below is rotatably mounted.

The rotary shaft 273 has a plurality of discs constituting the drum 280. The discs are arranged with regular intervals in the longitudinal direction of the rotary shaft 273.

Accordingly, oil is adsorbed and separated. The lipophilic recoverer enables oil to stick to the surfaces of the discs while a lipophilic adsorbent moves in an oil film, and enables oil sticking to the surfaces of the discs to be separated by being scraped or squeezed by a drum scraper 284.

In this embodiment, the drum scraper 284 protrudes from the frame body 271 facing the drum 280. The drum scraper 284 may be formed in a saw shape to be able to separate oil and foreign substances from the surface of the drum 280.

Oil separated by the drum scraper 284 can be sent to the oil storage tank 500 through the tube 233 connected to the disc-type oil recoverer 270. Alternatively, the an external discharge hose H may be connected to an outlet (not shown) formed at a side of the disc-type oil recoverer 270, whereby the oil separated by the drum scraper 284 may be directly transferred to the outside.

Meanwhile, the skimmer assembly may include a vacuum suction skimmer 300 and a vacuum tank 400. As shown in FIGS. 2 and 2, the vacuum suction skimmer 300 may be disposed behind the rotary skimmer 200. The vacuum suction skimmer 300 can be more effectively used when recovering a large amount of floating oil, a lump of oil, oil collected at a shore, etc. The vacuum suction skimmer 300, if necessary, may be used together with the rotary skimmer 200.

As shown well in FIG. 2, the vacuum suction skimmer 300 has a suction plate 310. In this embodiment, the suction plate 310 may extend to have a width corresponding to the width of the four-wheel vehicle 110.

As shown in FIG. 2, the suction plate 310 may have a suction space 311. The suction space 311 may be open downward on a side and may be tapered such that the width gradually decreases upward. This is for enabling oil, etc. to be easily suctioned along the inner surface of the suction space 311. To this end, the suction space 311 is connected to a vacuum suction pipe 420 to be described below.

A mesh net (not shown) may be installed at the inlet of the suction space 311. The mesh net may be coupled to the inlet of the suction space 311 by sliding. The mesh net is provided to filter out foreign substances larger than the diameter of the vacuum suction pipe 420 connecting the vacuum suction skimmer 300 and the vacuum tank 400 to each other.

As shown in FIG. 2, the vacuum suction skimmer 300 may have an up-down actuator 320. A side of the up-down actuator 320 is connected to the suction plate 310 and another side thereof is connected to the four-wheel vehicle 110. The up-down actuator 320 moves up and down the suction plate 310.

In this embodiment, the up-down actuator 320 may be composed of a cylinder 330 and a piston 340. The cylinder 330 is connected to the front wheels of the four-wheel vehicle 110. The cylinder 330 may be provided in a pair.

A side of the piston 340 is disposed to be able to move up and down in the cylinder 330 and another side thereof is connected to the upper portion of the suction plate 310. Accordingly, the distance of the suction plate 310 from the ground can be changed in the length of the piston 340 exposed from the cylinder 330.

Meanwhile, the vacuum tank 400 is mounted on the four-wheel vehicle 110. The vacuum tank 400 transmits vacuum suction force to the vacuum suction skimmer 300, whereby it is possible to suction adhering oil, collecting oil, high-viscosity oil, etc., and discharge the suctioned adhering oil, low-viscosity oil, high-viscosity oil, etc. to the outside, for example, to the external discharge hose H of a specific carrying vehicle.

As shown in FIG. 1, a portable nozzle 430 may be connected to the vacuum tank 400. The portable nozzle 430, which is directly held and used by a user, is provided to adsorb and remove oil at a narrow space that the vacuum suction skimmer 300 has difficulty in reaching or at a position to which an amphibious vehicle 101 moves.

Meanwhile, as shown in FIG. 1, the oil storage tank 500 is mounted on the four-wheel vehicle 110. The oil storage tank 500 is a part in which the oil recovered by the rotary skimmer 200 is kept. To this end, the first transfer line 232A is connected to the oil storage tank 500.

An outlet 510 may be formed on a side of the oil storage tank 500. Oil, marine wastes, etc. stored in the oil storage tank 500 are discharged to the outside through the outlet 510. The outlet 510 may be connected to the external discharge hose H of a specific carrying vehicle, etc.

Meanwhile, though not shown, the four-wheel vehicle 110 may have a washing water tank and a water spray nozzle that receives water from the washing water tank and sprays washing water. This is for dissolving oil remains by spraying washing water through the water spray nozzle after removing and recovering oil using the skimmer assembly.

Meanwhile, the multifunctional recovery apparatus of shore adhesion oils may include a controller (not shown). The controller controls the operation of the rotary skimmer 200, the up-down actuator 320, the vacuum suction skimmer 300, the vacuum tank 400, etc.

Figure 7:
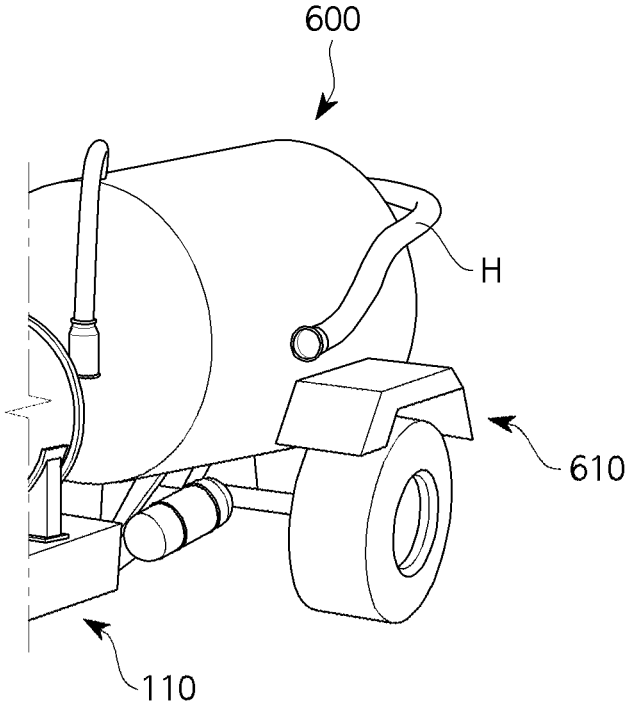
FIG. 7 is a perspective view partially showing the configuration of the multifunctional recovery apparatus of shore adhesion oils according to an embodiment of the present disclosure.

Meanwhile, as shown in FIG. 7, the multifunctional recovery apparatus of shore adhesion oils may include an oil recovery tank 600. In this embodiment, the oil recovery tank 600 is disposed on a trailer 610 that is towed by the four-wheel vehicle 110, but present disclosure is not limited thereto. For example, the oil recovery tank 600 may be mounted on the four-wheel vehicle 110.

The oil recovery tank 600 is connected by the external discharge holes H, etc., thereby being able to store oil, etc. transferred from the oil storage tank 500, the transfer pump 232, the vacuum tank 400, etc. When the oil recovery tank 600 is fully filled with oil, etc., it is possible to quickly replace the oil recovery tank 600 by separating only the trailer 610, whereby it is possible to deal with a large amount of oil within short time.

According to the present disclosure having the configuration described above, the skimmer assembly mounted on the four-wheel vehicle 110 that can be driven even on an off-road can separate oil sticking to the surfaces of sand and gravel at a shore, and can adsorb and recover oil that has reached a shore. Accordingly, it is easy to approach and move around on a shore in consideration of the characteristics of the shore, to remove a large amount of oil within short time, to reduce time and costs for oil spill cleanup, and to safely perform work.

Further, it is possible to separate and adsorb oil sticking to the surfaces of rocks at a shore using the rotary skimmer 200 and then transfer the oil to the oil storage tank 500. Further, it is possible to adsorb and recover oil not recovered by the rotary skimmer 200 and a lump of oil, etc. floating on a water surface using the vacuum suction skimmer 300.

When there is a large amount of oil to be removed, it is possible to adsorb and remove the large amount of oil using both of the rotary skimmer 200 and the vacuum suction skimmer 300. In this case, it is possible to store the large amount of recovered and removed oil directly in a specific carrying vehicle, for example, the oil recovery tank 600 rather than the oil storage tank 500 and the vacuum tank 400 in a vehicle. Accordingly, it is possible to deal with a large amount of within short time.

As described above, exemplary embodiments of the present disclosure were disclosed in the specification and drawings, but it should be understood that the embodiments are merely used for easily explain the present disclosure and helping understand the present disclosure without limiting the scope of the present disclosure. It is apparent to those skilled in the art that the present disclosure may be modified in various ways on the basis of the spirit of the present disclosure other than the embodiments described herein.

What is claimed is:

1. A multifunctional recovery apparatus of shore adhesion oils that is mounted on a four-wheel vehicle and removes and recovers oil flowing to a shore or oil stuck to the shore, the multifunctional recovery apparatus comprising:

a skimmer assembly installed at the front of the four-wheel vehicle, separating oil sticking to a surface of sand or gravel at a shore, and absorbing and recovering oil flowing to the shore; and an oil storage tank selectively receiving oil recovered from the skimmer assembly, wherein the skimmer assembly comprises:

a rotary skimmer separating and collecting oil sticking to a surface of sand or gravel at a shore; and a vacuum suction skimmer disposed behind the rotary skimmer and adsorbing oil flowing on a water surface, wherein the rotary skimmer comprises:

a skimmer body configured to separate oil;

a scraper protruding toward the skimmer body to separate oil and foreign substances from the skimmer body;

a discharge pipe configured to discharge the oil and the foreign substances separated by the scraper to the outside; and a transfer pump disposed under the scraper and transferring oil and water dropping from a lower portion of the scraper to the oil storage tank or to the outside, and wherein an oil recovery bag for recovering the discharged oil and foreign substances is detachably coupled to an outlet of the discharge pipe.

2. The multifunctional recovery apparatus of claim 1, wherein the transfer pump comprises:

a first transfer line having a first end connected to the transfer pump and a second end connected to the oil storage tank; and a second transfer line having a first end connected to the transfer pump and a second end connected to an external discharge hose provided from the outside, and a valve selectively opening and closing the second transfer line is disposed at the first end of the second transfer line.

3. The multifunctional recovery apparatus of claim 2, wherein the skimmer body comprises:

a separator disposed to be able to horizontally rotate and having coupling protrusions at both ends, respectively;

a cover plate having both sides to which both ends of the separator are rotatably coupled, respectively, and shielding an upper portion of the separator;

a guide screw rotatably disposed inside the cover plate and transferring oil and foreign substances separated by the scraper to the discharge pipe; and an oil storage container disposed under the scraper, receiving oil and water dropping from the lower portion of the scraper, and having the transfer pump therein.

4. The multifunctional recovery apparatus of claim 3, wherein the separator comprises:

a rotary roller disposed to be able to rotate horizontally with respect to the ground; and a brush spirally disposed on an outer surface of the rotary roller in a longitudinal direction, wherein the brush is a bunch of fibers made of a lipophilic material.

5. The multifunctional recovery apparatus of claim 3, wherein the separator comprises a rotary drum disposed to be able to rotate horizontally with respect to the ground, and a surface of the rotary drum has lipophilicity.

6. The multifunctional recovery apparatus of claim 3, wherein the skimmer assembly further comprises a vacuum tank connected to the vacuum suction skimmer and transmitting vacuum suction force to the vacuum suction skimmer.

7. The multifunctional recovery apparatus of claim 6, further comprising an up-down actuator having a first side connected to the vacuum suction skimmer and a second side connected to the four-wheel vehicle, and moving up and down the vacuum suction skimmer.

8. The multifunctional recovery apparatus of claim 3, further comprising connection arms disposed in parallel with each other at the front of the four-wheel vehicle, each having a first side hinged to the front of the four-wheel vehicle and a second side connected to the cover plate.

9. The multifunctional recovery apparatus of claim 8, wherein a tongs-shaped gripper is disposed at the second ends of the connection arms, so the rotary skimmer is separably coupled.

10. The multifunctional recovery apparatus of claim 9, wherein a disc-type oil recoverer is separably coupled to the grippers.

11. The multifunctional recovery apparatus of claim 10, wherein the disc-type oil recoverer comprises:

a frame body forming an external shape and a frame;

a rotary shaft rotatably installed on the frame body;

a drum composed of a plurality of discs arranged on the rotary shaft with regular intervals in a longitudinal direction of the rotary shaft; and a drum skimmer protruding from the frame body facing the drum and separating oil and foreign substances from a surface of the drum.

12. The multifunctional recovery apparatus of claim 11, wherein the frame body is made of fiber reinforced plastics (FRP).

* * * * *